United States Patent [19]

Stumpp et al.

[11] 3,983,856

[45] Oct. 5, 1976

[54] FUEL INJECTION SYSTEM

[75] Inventors: Gerhard Stumpp, Stuttgart; Reinhard Schwartz, Stuttgart-Sillenbuch, both of Germany

[73] Assignee: Robert Bosch G.m.b.H., Stuttgart, Germany

[22] Filed: May 13, 1975

[21] Appl. No.: 577,061

[30] Foreign Application Priority Data

May 24, 1974 Germany ..... 2425021

[52] U.S. Cl. ..... 123/139 AW; 123/119 R

[51] Int. Cl.[2] ..... F02M 7/20

[58] Field of Search ..... 123/139 AW, 119 R

[56] References Cited

UNITED STATES PATENTS

| | | | |
|---|---|---|---|
| 3,791,359 | 2/1974 | Eckert et al. | 123/139 AW |
| 3,835,828 | 9/1974 | Knapp | 123/119 R |
| 3,842,813 | 10/1974 | Eckert | 123/119 R |
| 3,894,523 | 7/1975 | Stumpp | 123/139 AW |

*Primary Examiner*—Wendell E. Burns
*Assistant Examiner*—David D. Reynolds
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, a pressure control valve connected to the control pressure conduit and a further conduit for connecting the pressure control valve to the suction tube of the engine downstream of the butterfly valve. With this structure it is possible to alter the restoring force mentioned above so that a momentarily enriched fuel-air mixture is achieved when the butterfly valve is suddenly opened and so that a momentarily weakened fuel-air mixture is achieved when the butterfly valve is suddenly closed.

5 Claims, 1 Drawing Figure

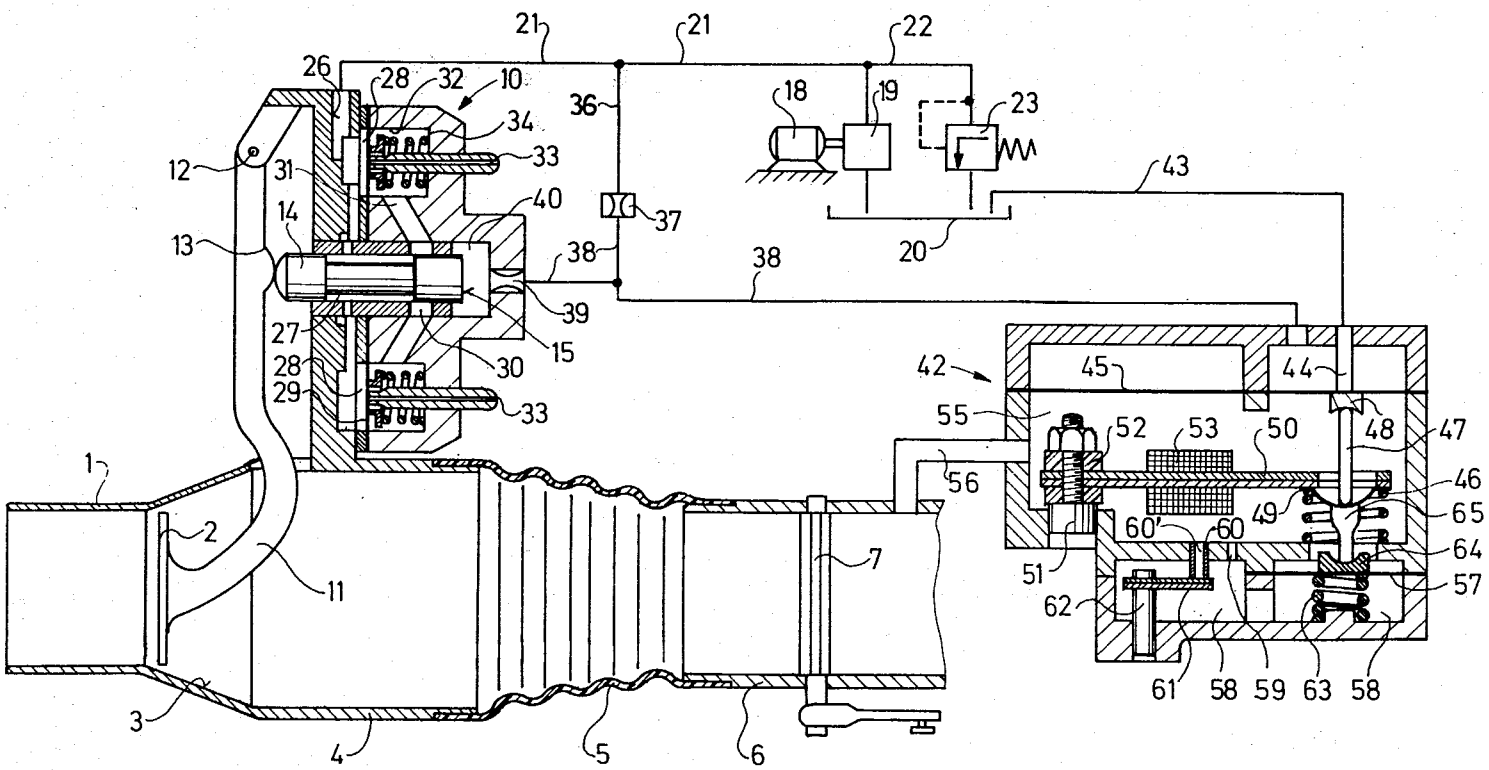
1
2
3
4
5
6
7
10
11
12
13
14
15
18
19
20
21
22
23
26
27
28
29
30
31
32
33
34
36
37
38
39
40
42
43
44
45
46
47
48
49
50
51
52
53
55
56
57
58
59
60
60'
61
62
63
64
65

FUEL INJECTION SYSTEM

BACKGROUND OF THE INVENTION

The present invention relates to a fuel injection system for an externally ignited internal combustion engine.

The system according to the present invention operates on fuel which is continuously injected into the suction tube of the engine in which a sensing element and an arbitrarily operable throttle valve (butterfly valve) are disposed in series. The sensing element is displaced by and in proportion to the quantity of air flowing through the suction tube against a restoring force. In the course of its excursion, the sensing element displaces a movable component of a valve which is disposed in the fuel supply line and which is intended for metering a quantity of fuel which is proportionate to the quantity of air. The afore-noted restoring force is supplied by liquid under pressure which is delivered continuously under constant, but arbitrarily variable pressure through a control pressure line. The pressurized liquid exerts a force on a control plunger. The pressure of the pressurized liquid is variable by at least one pressure control valve controllable as a function of the engine parameters. The pressure control valve preferably takes the form of a flat seat valve comprising a valve membrane (diaphragm) as the movable valve part.

Fuel injection systems of this type are designed to automatically provide a good fuel-air mixture for all operational conditions of the internal combustion engine so as to burn the fuel as completely as possible and thus prevent toxic gases from being produced, or at least to considerably reduce the same while obtaining maximum performance of the internal combustion engine with minimum fuel consumption. The quantity of fuel must therefore be very accurately metered in accordance with the requirements of each operational state of the internal combustion engine.

In the case of known fuel injection systems of this type, the quantity of fuel which is metered is, as far as possible, proportionate to the quantity of air flowing through the suction tube. The ratio of the quantity of fuel which is metered to the quantity of air may be varied by changing the restoring force of the sensing element as a function of the operating parameters by means of an electromagnetically actuated pressure control valve.

It has been found that it is advantageous to momentarily enrich the fuel-air mixture when the throttle valve (butterfly valve) is suddenly opened and to momentarily weaken the fuel-air mixture when the throttle valve is suddenly closed.

OBJECT AND SUMMARY OF THE INVENTION

The principal object of the present invention is to provide a fuel injection system of the known type, by means of which the fuel-air mixture is momentarily enriched or weakened during load changes of the internal combustion engine.

This object and others are accomplished according to the present invention in that for the purpose of changing the fuel-air ratio during load change, a pressure control valve is provided which comprises two pressure chambers separated by a control membrane. The first of these pressure chambers is in communication with the suction tube of the engine downstream of a throttle valve, which is mounted within the suction tube, via a pressure conduit; while the second pressure chamber communicates with the first pressure chamber via a throttle bore. A control spring acting on the control membrane is disposed in the second chamber and a valve spring acting on a valve membrane is disposed in the first chamber with a connecting element being disposed between the valve membrane and the control membrane.

An advantageous feature of the present invention results from the arrangement in which a balance bore disposed parallel to the throttle bore between the two pressure chambers is controllable by a temperature dependent element. The element which operates in dependence on the temperature consists of a bi-metallic control spring which opens the balance bore upon termination of the warm-up stage of the engine.

Another advantageous feature of the present invention results from the arrangement in which at temperatures below the operating temperature of the engine, the closing force exerted on the valve membrane may be reduced by an electrically heatable bi-metallic valve spring.

Yet another advantageous feature of the present invention results from the arrangement of the throttle bore in the control membrane.

A preferred embodiment of the present invention is represented in the drawing and will be described in detail hereinafter.

BRIEF DESCRIPTION OF THE DRAWING

The sole FIGURE illustrates a fuel injection system according to a preferred embodiment of the present invention including the structure for varying the fuel-air ratio of the fuel mixture delivered to the engine during engine load changes.

DESCRIPTION OF THE PREFERRED EMBODIMENT

In the fuel injection system illustrated, the combustion air flows in the direction of the arrow through a suction tube portion 1 past an air sensing element or air sensor 2, which is disposed in a conical portion 3. From the conical portion 3 the air flows in a suction tube portion 4 and thereafter through a coupling hose 5 into a suction tube portion 6 in which there is disposed an arbitrarily operable throttle valve (butterfly valve) 7. From the latter the combustion air flows to one or more cylinders (not shown) of an internal combustion engine. The air sensor 2 consists of a plate disposed at right angles to the direction of air flow and is displaced in the conical suction tube portion 3 as an approximately linear function of the air flowing through the suction tube. Given a constant restoring force exerted on the air sensor 2 as well as a constant pressure prevailing upstream of the air sensor 2, the pressure prevailing between the air sensor 2 and the throttle valve 7 also remains constant.

The air sensor 2 directly controls a fuel metering and distributing valve 10. For the transmission of the motion of the air sensor 2 there is provided a lever 11 which is connected to the air sensor at one end and pivotably mounted by a pivot point 12 at the other end. The lever 11 is provided with a nose 13 and during the pivoting movement of the lever 11, the nose 13 actuates the movable slide member 14 which forms part of the fuel metering and distributing valve 10. The slide member 14 serves as a control plunger including a front face 15, which is remote from the nose 13. The front face 15 is exposed to the force of pressurized liquid. The pressure of this liquid acting on the face 15 produces the restoring force on the air sensor 2.

Fuel is supplied by means of a fuel pump 19 which is driven by an electric motor 18 and which draws fuel from a fuel tank 20 and delivers it through a conduit 21 to the fuel metering and distributing valve 10. From the conduit 21 there extends a conduit 22 in which is disposed a pressure limiting valve 23. When there is excessive pressure in the system the pressure limiting valve allows fuel to flow back into the fuel tank 20.

From the conduit 21 the fuel is admitted into a channel 26 provided in the housing of the fuel metering and distributing valve 10. The channel 26 leads to an annular groove 27 of the control plunger 14 and further leads through several branch conduits to the chambers 28 on one side of a membrane so that the one side of the membrane 29 is exposed to fuel pressure. Dependent upon the axial position of the control plunger 14, the annular groove 27 overlaps and as a result opens to a greater or lesser extent control slots 30 which lead through channels 31 to chambers 32. Each of the latter is separated from a corresponding chamber 28 by means of the membrane 29. From the channels 32 the fuel is admitted through injection channels 33 to the individual fuel injection valves (not shown) which are positioned in the suction tube in the vicinity of a corresponding engine cylinder. The membrane 29 serves as the movable part of a flat seat valve which, when the fuel injection system is inoperative, is maintained open by means of the springs 34. The membrane boxes, each formed of a chamber 28 and 32, ensure that, independently of the overlap between the annular groove 27 and the control slots 30, that is, independently of the quantity of fuel flowing to the fuel injection valves, the pressure drop at the fuel metering valves 27, 30 remains substantially constant. In this way, it is ensured that the extent of displacement of the control plunger 14 and the metered fuel quantity are proportionate to one another.

Upon a pivotal movement of the lever 11, the air sensor 2 is moved in the conical portion 3 of the suction tube and, as a result, the annular flow passage section between the air sensor 2 and the cone changes in proportion to the extent of the displacement of the air sensor 2.

The liquid producing the constant restoring force on the control plunger 14 is fuel. For this purpose, from the conduit 21 there extends a conduit 36 which is separated from a pressure control conduit 38 by means of an uncoupling throttle 37. A pressure chamber 40 communicates with the control pressure conduit 38 via a damping throttle 39. The front face 15 of the control plunger 14 projects into the pressure chamber 40.

A pressure control valve 42 is disposed in the control pressure conduit 38. The pressurized fluid can pass to the fuel tank 20 through a depressurized return conduit 43 via the pressure control valve 42. The pressure of the pressurized liquid producing the restoring force can be varied in a temperature-dependent manner and in dependence on load changes by means of the pressure control valve 42. The pressure control valve 42 is in the form of a flat seat valve having a stationary valve seat 44 and a valve membrane 45 which is bias-loaded in the closing direction of the valve, inter alia, by a spring 46. The valve spring 46 exerts pressure on the valve membrane 45 via a pin 47 which is disposed between a bearing seat 48 connected to the valve membrane 45 and a spring rest 49. At temperatures below the engine operating temperature the closing force transmitted to the pressure control valve 42 by the valve pin 47 works against a bi-metallic spring 50 which, during the warm-up stage, rests at its one end against the spring rest 49. The other end of the spring 50 is secured by means of a bolt 51, which is pressed into the housing of the pressure control valve 42. The bi-metallic spring 50 is largely protected against losing heat to the housing of the pressure control valve by means of an insulating element 52 disposed between the bolt 51 and the bi-metallic spring 50. An electric heater 53, which is energized in a conventional manner, is placed on the bi-metallic spring 50.

A first pressure chamber 55 of the pressure control valve 42 is in communication with the suction tube pressure of the suction tube portion 6 downstream of the throttle valve 7 and is separated from a second pressure chamber 58 by a control membrane 57. The first pressure chamber 55 and the second pressure chamber 58 are in constant communication via a throttle bore 59. The throttle bore 59 can also be disposed in the control membrane 57, although it is not represented in this way in the embodiment illustrated. A pin 60 defining a balance bore 60' is provided parallel to the throttle 50. The balance bore 60' is controllable by means of a temperature or time-dependent element. The temperature-dependent element can consist, for example, of a bi-metallic control spring 61 which opens the balance bore 60' upon termination of the warm-up stage of the engine. In the course thereof, the bi-metallic control spring 61 can be heated by direct heat contact with the internal combustion engine or by means of an electric heating element (not shown). The end of the bi-metallic spring 61 remote from the balance bore 60' is connected to a bolt 62 which is pressed into the housing of the pressure control valve 42.

A control spring 63 acting on the control membrane 57 is disposed in the second pressure chamber 58. The side of the control membrane 57 remote from the control spring 63 bears a seat 64. One end of a transmission pin 65 rests on the seat 64 and the other end of the pin 65 engages with the spring rest 49.

The fuel injection system operates in the following manner:

When the internal combustion engine is running, fuel is drawn from the tank 20 by the pump 19 driven by the electric motor 18 and forced through the conduit 21 to the fuel metering and distributing valve 10. At the same time, the internal combustion engine draws air through the suction tube 1 and, as a result, the air sensor 2 undergoes a certain excursion from its rest position. In response to the deflection of the air sensor 2, the control plunger 14 is displaced via the lever 11 and thus the flow passage section at the control slots 30 is increased. The direct connection between the air sensor 2 and the control plunger 14 ensures a constant ratio between the quantity of air and the metered quantity of fuel provided the characteristics of these two components are sufficiently linear (which is desideratum by itself). In such a case, the fuel-air ratio would be constant for the entire operational range of the engine. However, it is necessary for the fuel-air mixture to be richer or leaner depending on the operational conditions and this is achieved by varying the restoring force acting on the air sensor 2. For this purpose there is provided in the control pressure conduit 38 the pressure control valve 42 which, by influencing the pressure of the pressurized liquid during the warm-up phase of the internal combustion engine, influences the fuel-air ratio as a funtion of the temperature and during load changes, until the operating temperature of the internal combustion engine is reached. The control pressure is determined by the closing force transmitted to the valve membrane 45 by the valve pin 47. However, at temperatures below the operating temperature of the internal combustion engine the bi-metallic valve spring 50 exerts a force against the spring rest 49 against the force of the spring 46 and the force transmitted to the spring rest 49 by the transmission pin 65, thereby reducing the closing force exerted on the membrane 45. However, immediately after the engine is started, the bi-metallic valve spring 50 is heated by means of the electric heater 53 which results in a reduction in the force transmitted by the bi-metallic spring 50 onto the spring rest 49. The requisite initial biasing of the spring 50 can be achieved by pressing the bolt 51 to a varying depth in the housing of the pressure control valve 42.

When there is a sudden acceleration of the internal combustion engine, according to the present invention the pressure of the pressurized fluid in the control pressure conduit 38 is reduced for the purpose of obtaining an acceleration fuel quantity in addition to the quantity of fuel metered at the metering and distributing valve 10 in dependence on the quantity of air drawn in, thus enabling a richer fuel-air mixture to be obtained. As a result of a reduction in the pressure of the pressurized liquid in the control pressure conduit 38, the restoring force exerted on the air sensor 2 is reduced and, as a result, while the throughgoing quantity of air remains constant, the deflection of the air sensor 2 and thus of the control plunger 14 is more extensive, whereupon an increased quantity of fuel is metered at the metering valve 27, 30.

The reduction in the pressure of the pressurized liquid in the control pressure conduit 38 occurs as a result of the fact that when there is a sudden acceleration of the internal combustion engine the pressure in the suction tube portion 6 downstream of the throttle valve 7, increases, thereby producing a pressure difference at the control membrane 57. This pressure difference results in a reduction of the force of the control spring 63 on the transmission pin 65 and thus of the closing force exerted on the membrane 45. The acceleration enrichment is temporally limited by the selection of the cross-section of the throttle bore 59, by means of which pressure equalization can be produced between the first pressure chamber 55 and the second pressure chamber 58. The volume of the second pressure chamber 58 serves as a further factor which can determine the period of enrichment. The time factor can also be varied by virtue of the fact that the balance bore 60' is disposed, parallel to the throttle bore 59. This balance bore 60' is opened by the bi-metallic spring 61 upon termination of the warm-up stage of the internal combustion engine.

If there is a reduction in the suction tube pressure downstream of the throttle valve 7 during deceleration of the internal combustion engine, there is produced at the control membrane 57, a pressure difference which leads to an increase in the closing force exerted on the membrane 45, whereupon the pressure in the control pressure conduit 38 increases and a reduced quantity of fuel is metered at the metering valves 27, 30. As a result, the fuel-air mixture is weakened until pressure equalization is effected between the first pressure chamber 55 and the second pressure chamber 58 via the throttle bore 59 or the balance bore 60'.

What is claimed is:

1. A fuel injection system for externally ignited internal combustion engines comprising, in combination:

a. a suction tube for air intake to the engine;
b. an air sensor disposed in said suction tube;
c. an arbitrarily operable butterfly valve disposed in said suction tube in series with said air sensor;
d. a fuel supply conduit;
e. a control pressure conduit;
f. a fuel metering valve connected to said fuel supply conduit and said control pressure conduit for continuously injecting fuel into said suction tube;
g. a control plunger, serving as the movable member of said fuel metering valve, said control plunger being acted upon on one end by said air sensor, and on an opposite end by a return force provided by liquid under constant but arbitrarily variable pressure delivered by said control pressure conduit, for metering a fuel quantity that is proportionate to the quantity of air measured by said air sensor; and
h. at least one pressure control valve in the form of a flat seat valve having a membrane as the movable valve part, said pressure control valve being disposed in said control pressure conduit for varying pressure in said control pressure conduit in dependence on at least one operating parameter of the engine and thereby varying the fuel-air ratio during load changes wherein said pressure control valve includes:
   i. a valve membrane;
   ii. a control membrane;
   iii. two pressure chambers separated; from one another by said control membrane;
   iv. a pressure conduit connected to a first one of the pressure chambers and to the suction tube downstream of the butterfly valve;
   v. means defining a throttle bore within the pressure control valve for connecting the pressure chambers;
   vi. a control spring disposed in the second one of the pressure chambers, said control spring acting against the control membrane;
   vii. a valve spring disposed in the first one of the pressure chambers, said valve spring acting against the valve membrane; and
   viii. connecting means in the first one of the pressure chambers extending between and connecting the valve membrane and the control membrane.

2. The fuel injection system as defined in claim 1, wherein the pressure control valve further includes:

means defining a balance bore which connects the two pressure chambers; and
a temperature-dependent element disposed parallel to the throttle bore for controlling the balance bore.

3. The fuel injection system is defined in claim 2, wherein the temperature-dependent element comprises a bi-metallic control spring which opens the balance bore upon termination of the warm-up stage of the engine.

4. The fuel injection system as defined in claim 1, wherein the pressure control valve further includes an electrically heatable bi-metallic valve spring which engages the valve spring, and wherein the closing force exerted on the valve membrane may be reduced by means of the electrically heatable bi-metallic valve spring acting against the valve spring at temperatures below the operating temperature of the engine.

5. The fuel injection system as defined in claim 1, wherein the means defining the throttle bore is the control membrane, so that the throttle bore is formed in the control membrane.

* * * * *